US005203965A

United States Patent [19]

McCowan

[11] Patent Number: 5,203,965

[45] Date of Patent: Apr. 20, 1993

[54] UTILIZATION OF SAWDUST FOR PULP PRODUCTION

[75] Inventor: James L. McCowan, Eugene, Oreg.

[73] Assignee: Pope & Talbot, Inc., Portland, Oreg.

[21] Appl. No.: 657,358

[22] Filed: Feb. 19, 1991

Related U.S. Application Data

[63] Continuation of Ser. No. 213,631, Jun. 30, 1988, abandoned.

[51] Int. Cl.[5] ..... D21H 11/00; D21H 15/00; B07B 1/50; B07B 1/54

[52] U.S. Cl. ..... 162/55; 162/71; 162/142; 162/150; 209/2; 209/10; 209/381; 209/382; 209/315

[58] Field of Search ..... 162/13, 71, 55, 142, 162/150; 209/2, 10, 381, 382, 323, 315

[56] References Cited

U.S. PATENT DOCUMENTS

| | | | |
|---|---|---|---|
| 232,840 | 10/1880 | Newell | 162/150 |
| 1,162,488 | 11/1915 | Johnson | 209/3 |
| 1,628,549 | 5/1927 | Magondeaux | 162/55 |
| 2,065,395 | 12/1936 | Richter | 162/71 |
| 2,114,406 | 4/1938 | Simpson | 209/403 |
| 2,231,953 | 2/1941 | Ruzicka | 162/71 |
| 2,269,289 | 1/1942 | Schifflin | 209/323 |
| 2,497,902 | 2/1950 | Moyer | 209/381 |
| 2,858,023 | 10/1958 | Holland | 209/381 |
| 3,565,251 | 2/1971 | Pennington | 209/381 |
| 4,116,758 | 9/1978 | Ford | 162/71 |
| 4,122,006 | 10/1978 | Christensen | 209/382 |
| 4,259,148 | 3/1981 | Beath | 162/71 |
| 4,288,320 | 9/1981 | Wilson | 209/382 |
| 4,496,718 | 1/1985 | Rudy | 162/71 |
| 4,498,981 | 2/1985 | Frevert | 209/381 |
| 4,526,682 | 7/1985 | Wallace | 209/381 |
| 4,562,969 | 1/1986 | Lindahl | 162/55 |

FOREIGN PATENT DOCUMENTS

| | | | |
|---|---|---|---|
| 117086 | 5/1919 | United Kingdom | 162/150 |

OTHER PUBLICATIONS

Sawdust Pulping at Longview Fibre-Pulp & Paper Oct. 26, 1964 vol. 38, #37, pp. 52-54.

*Primary Examiner*—Stanley S. Silverman
*Assistant Examiner*—Thomas M. Lithgow
*Attorney, Agent, or Firm*—Robert L. Harrington

[57] ABSTRACT

A screening system incorporated into the system of sawdust collection for paper producing pulp. An upper and lower range of the sawdust particles is designated as between smaller, strength-inhibiting size particles and larger strength-enhancing size particles. A screen is provided to screen out the smaller size particles. The screen is made out of stainless steel to avoid rusting and corroding and also to more readily pass the moistened smaller size particles. The screen is sloped and agitated to induce shuffling of the sawdust mixture, the process of which results in a separation of about 50% of the particles as rejected smaller size particles and 50% as acceptable larger size particles desirable for paper producing pulp.

5 Claims, 2 Drawing Sheets

UTILIZATION OF SAWDUST FOR PULP PRODUCTION

This is a continuation of co-pending application Ser. No. 07/213,631, filed on Jun. 30, 1988, now abandoned.

FIELD OF INVENTION

This invention relates to the utilization of sawdust generated in lumber mills, and more particularly it relates to the utilization of a selected size range of particles from the sawdust mixture to be used as a pulp ingredient for paper production.

BACKGROUND OF THE INVENTION

The production of paper products involves the utilization of wood fiber that is extracted out of wood particles such as wood chips, e.g. chunks of wood of varying thickness in a range of about ⅜ inch to 1 inch. The wood chips are, in effect, cooked under controlled conditions resulting in the fibers being released from the structure of the wood. These fibers are suspended in a slurry that is referred to as pulp. The pulp is subsequently used as the primary ingredient for producing paper.

Many different types of paper are produced from wood pulp and the different types have different strength requirements. For example, newspaper, wrapping paper, and the like, must be stronger than tissue paper or writing paper. Tissue paper must be softer and in some applications, tear easily. Also, a paper's strength is negatively effected by bleaching which is required for some paper products (writing paper and tissue paper) while other paper products remain unbleached (cardboard boxes and grocery bags). It is the length of the wood fibers of the pulp that largely determines the strength of the paper.

As a control factor for determining the makeup of the fibers that go into the pulp mixture for making the various paper products, the pulp mixture is graded according to burst strength, tear strength and breaking strength. These strength characteristics are collectively referred to as the pulp's TSF (total strength factor). A high TSF requirement generally demands a greater proportion of long fibered pulp.

Paper products such as tissue paper, are commonly produced from pulp that has a low TSF. Such pulp can be produced from short wood fibers or it can be produced from a combination of the larger fibers of chip pulp and limited amounts of sawdust pulp. Sawdust pulp is generally considered merely a filler material, i.e. without significant TSF. In mills that use sawdust pulp, up to about 20% of the pulp mixture used for tissue paper production may be filler or sawdust pulp. The main reason that sawdust is used at all is that there are enormous quantities of sawdust available from lumber production and sawdust costs less than half the cost of wood chips.

Historically, sawdust was used in paper production to a greater proportion than exists currently. The reason is that sawmills have become more efficient in utilizing the log. Early saws created wide kerfs and in the process removed large sawdust particles (although small as compared to wood chip size). In tissue paper production the large sawdust particles were used at about a 70/30 ratio (chip pulp to sawdust pulp). As sawdust particles decreased in size, that ratio changed to about an 80/20 ratio which is commonly in use today. The reduction in size of the sawdust particles in producing sawdust pulp resulted in higher cost for tissue paper production as more and more of the higher priced wood chips were required.

SUMMARY OF THE INVENTION

The present invention is directed to the utilization of a greater proportion of sawdust in paper production, e.g. in tissue and writing paper products. The sawdust of modern mills in particular is considered essentially useless in supplying pulp with significant TSF (total strength factor). Paper producers through simple tests could see that the sawdust pulp was detrimental to the paper produced and were forced to reduce the proportion of the sawdust pulp (and conversely, increase the proportion of chip pulp) as necessary to obtain the desired strength properties.

The understanding that sawdust was a poor producer of wood pulp was common to the industry. The fact that larger sized sawdust particles were apparently more valuable than the efficiently produced smaller sized sawdust particles did not materially change that understanding. Anyone examining a quantity of sawdust would readily discern that the sawdust particles both before and after modernization are not of a consistent size but instead cover a broad range of sizes. The increased value of the larger sized sawdust was simply attributed to the presence of somewhat larger fibers in the sawdust mixture. It was a casual observation with little significance.

The present invention has established that a substantial portion of the sawdust fibers produced from modern sawmills, contrary to conventional wisdom, does indeed have the capacity to provide substantial strength for paper producing pulp. This is particularly true for the less demanding writing and tissue paper products. More importantly, it was learned that the quantity of sawdust "fines" or "flour" which also makes up a substantial portion of the sawdust mixture produces a negative strength factor. Whereas this statement alone is not particularly surprising, no one in the industry had any idea that processing the sawdust to remove the "flour" would have anywhere near the beneficial results for commercial production that was experienced. Conventional wisdom in the pulp producing industry assumed that some benefit may result from separating out the "flour" but the cost and inconvenience of doing so would far outweigh the benefits.

In the preferred method used for separating out the sawdust "flour", a screening apparatus is employed. The screening apparatus and method that was derived utilizes a fine stainless steel screen, mounted at a slight angle or slope, and an agitating mechanism for agitating the screen to thereby vibrate the sawdust down the sloped screen. The desired particles were carried across the screen surface while the unwanted sawdust "flour" was passed through the screen. A loss of about 45% of the total bulk of pre-screened sawdust resulted from using a number 12 size screen to screen out the "flour". The sawdust particles minus the "flour" was separately collected and its value for paper production was found to have increased many fold. Separating out the sawdust "fines" or "flour" has accordingly reversed the downward trend for the use of sawdust as a paper producing pulp. A very substantial percentage of the sawdust (55% in the example given) can now be utilized as a strength enhancing pulp and the economic impact on both lumber mill byproduct recovery and paper producing cost is substantial.

BRIEF DESCRIPTION OF DRAWINGS

The invention will be appreciated and understood more clearly by reference to the following detailed description having reference to the accompanying drawings wherein:

With reference to FIG. 1 of the drawings, a lumber mill 10 is indicated simply as a box. Raw logs 12 (probably debarked) are brought to the lumber mill (arrow 14) where numerous operations are performed on the log. On completion of the operations, the primary lumber product is shipped out of the mill 10 (arrow 16) in the form of various sized boards 18 (2×4's, of varying lengths, e.g. 4-feet, 8-feet, 12-feet, etc.; 2×6's, also of varying lengths, and so on).

Among the operations typically performed on the logs 12 are bucking (cutting the log to length), chipping (chipping off the unusable rounded sides and making the sides flat-faced), sawing (cutting the logs into cants and the cants into boards), and edging (cutting boards to width and thereby removing wane); to name but a few of the operations that take place in the processing of a log into lumber. The chipping operation intentionally produces specific sized wood chunks (e.g. ⅜ inch to 1 inch). This is permitted because of the need to square-up the log. The rounded sides that do not have sufficient dimension to form a board are simply removed as chips in that the chip fiber has a recognized value for pulp production.

Figure 1:
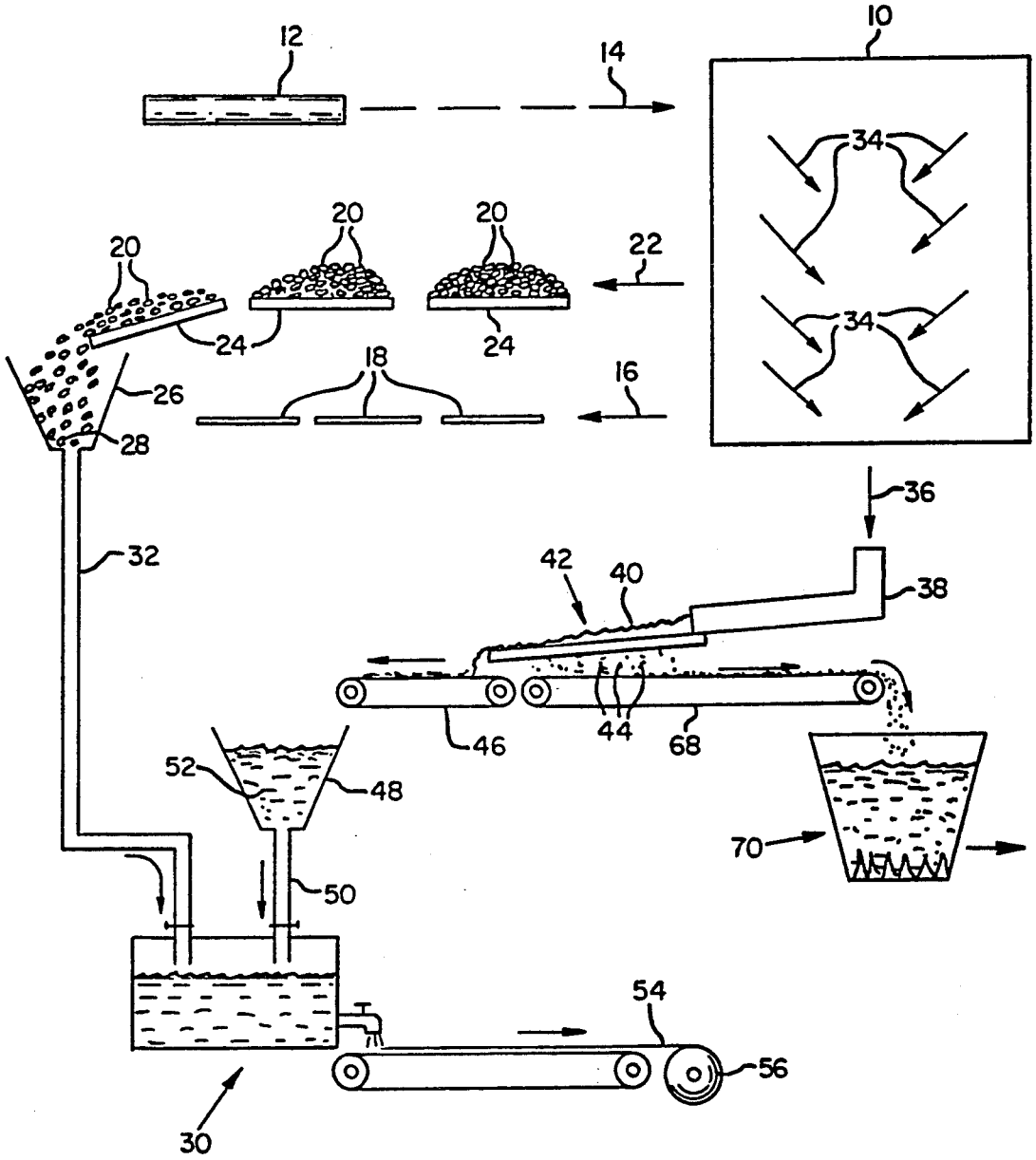
FIG. 1 is a schematic illustration of a total system for processing the by-products of a lumber mill into paper, utilizing the present invention.

The chips 20 are accumulated separately from the sawdust and shipped out of the lumber mill (arrow 22) as a valuable by-product, indicated in FIG. 1 as chip piles conveyed out of the plant 10 on pallets 24. The manner of conveyance is only for illustrative purposes and has no significance. More importantly, the chips 20 are conveyed to a "digester" 26 (pulp producing apparatus) where the chips are converted to chip pulp 28 which is then conveyed (e.g. through a tube conveyor 32) to a paper producing operation, generally indicated as station 30.

Of course, many, many operations take place in processing, conveying, and storing the chips 20 and the chip pulp 28 that are not specifically represented in the schematic flow diagram of FIG. 1. The specific operations are not a part of the invention and are thus not illustrated.

Most of the operations in lumber production do not have the luxury of removing wood waste as a chip by-product. The sawing operations produce sawdust. Ideally the cuts made to the log would be accomplished by slicing rather than sawing so that no sawdust was produced. However, that is not feasible (at least not with current technology). Sawing involves the generation of a kerf. Whereas sawing operations have become very efficient and the kerf widths have been dramatically reduced over the years, nevertheless each saw cut generates a small amount of wood waste in the form of sawdust.

Typically in a single mill operation, a total log will be processed every few seconds. The processing of a single log involves many cuts. The small amount of sawdust generated by a single cut when repeated a thousand thousand times over, quickly accumulates a mountain of sawdust. Consequently, continuous removal of the sawdust is required.

Referring to FIG. 1, arrows 34 indicate the internal conveyor system that is necessarily employed in every lumber mill for gathering the sawdust from the various operations and directing it out of the plant as indicated by arrow 36.

The disposal of the sawdust is a problem. Historically the sawdust has been used primarily as a fuel. The cost of handling the sawdust almost offsets the value of the sawdust as fuel. Thus as fuel, the sawdust is virtually given away.

An alternate use for the sawdust is as a filler material. It is used in particle board and paper for that purpose. The figures are not readily available, but a fair estimate is that about 70% of the sawdust was heretofore used as fuel and 30% as filler. Of the 30% used as filler, about 25% has been used for particle board production and 5% for paper production. A substantially higher price can be obtained for use of the sawdust as filler. The substantially higher price is still only one-third or less than the price of chips and to the extent that the sawdust will replace the chips, the savings to the paper production cost is significant.

Paper producers have been aware that the make up or size of sawdust particles have an important affect on its utility as a pulp ingredient. Thus it was observed with trepidation that sawdust particles became reduced in size as sawmills became more efficient. It was apparent that to maintain paper strength, a lower percentage of the smaller sized sawdust pulp and a correspondingly higher percentage of the chip pulp had to be used. That is, the mixture gradually regressed from a 70/30 ratio to an 80/20 ratio.

As previously explained, the benefits derived from the present invention reverse this regression of involving the use of sawdust in paper producing pulp. To accomplish that benefit, the process of the present invention substantially removes the "flour" or "fines" of the sawdust. "Flour" or "fines" sawdust as the terms are synonymously used herein encompass those sawdust particles that essentially have no fiber or at least fiber of no significant length. For example, a particle that will pass through a number 12 screen, e.g. about 1/16 of an inch, has no perceived TSF value. Yet particles about that size and up to number 3 screen size (about the largest particles found in an intermixture of sawdust) has substantial TSF value.

It is theorized that when a quantity of the previously unprocessed sawdust pulp was added to the chip pulp for paper production, up to 50% of the sawdust mixture was "flour". Adding the "flour" to the pulp created a weakness factor. That weakness factor severely limited the proportion of the unprocessed sawdust that could be utilized. For instance, if the intermixture of pulp (chips and sawdust) has 20% sawdust pulp, a total of 10% comprised the "flour" or "fines". An over-balanced proportion of the chip fibers (the 80%) was necessary to offset the weakness introduced by the "flour" and thus the resultant 80/20 ratio of chip pulp to sawdust pulp.

It follows that if the "flour" or "fines" sawdust is removed, i.e. processed out, a far higher percentage of the processed sawdust should be acceptable. The sawdust was thus screened to separate out the "flour" or "fines". To the extent that the results have been verified, it has been found that a far greater percentage of the processed sawdust can be used than was ever expected. Certainly the prior 70/30 ratio achievable in the rough cutting mills of old has been exceeded. The expectations now are that some tissue paper may be made with screened sawdust exclusively (i.e. no chip pulp).

The economic benefits of this discovery are important. Whereas sawdust as an ingredient for paper producing pulp has been viewed as a diminishing resource, now the sawdust by-product of a lumber mill can become a material of significant value. By screening the sawdust, up to 50% of the sawdust is made available for beneficial pulp production. It no longer need be considered as simply a filler material.

Returning now to FIG. 1, the sawdust is directed from the lumber mill 10, as indicated by arrow 36, through a tube conveyor 38. From the tube conveyor 38, the sawdust intermixture 40 is dumped onto a screening device 42. The screening device screens out the flour 44 and passes the "dimensional" sawdust particles, via a conveyor 46, to a sawdust cooker 48 where sawdust pulp 52 is produced.

Station 30, the paper producing operation, is simply intended to illustrate the combined utilization of chip pulp 28 provided through conveyor tube 32, and sawdust pulp 52, provided through conveyor tube 50. The mixture of the two pulp types is processed in a conventional manner, from which tissue paper 54 is produced and wound onto a paper roll 56.

Figure 2:
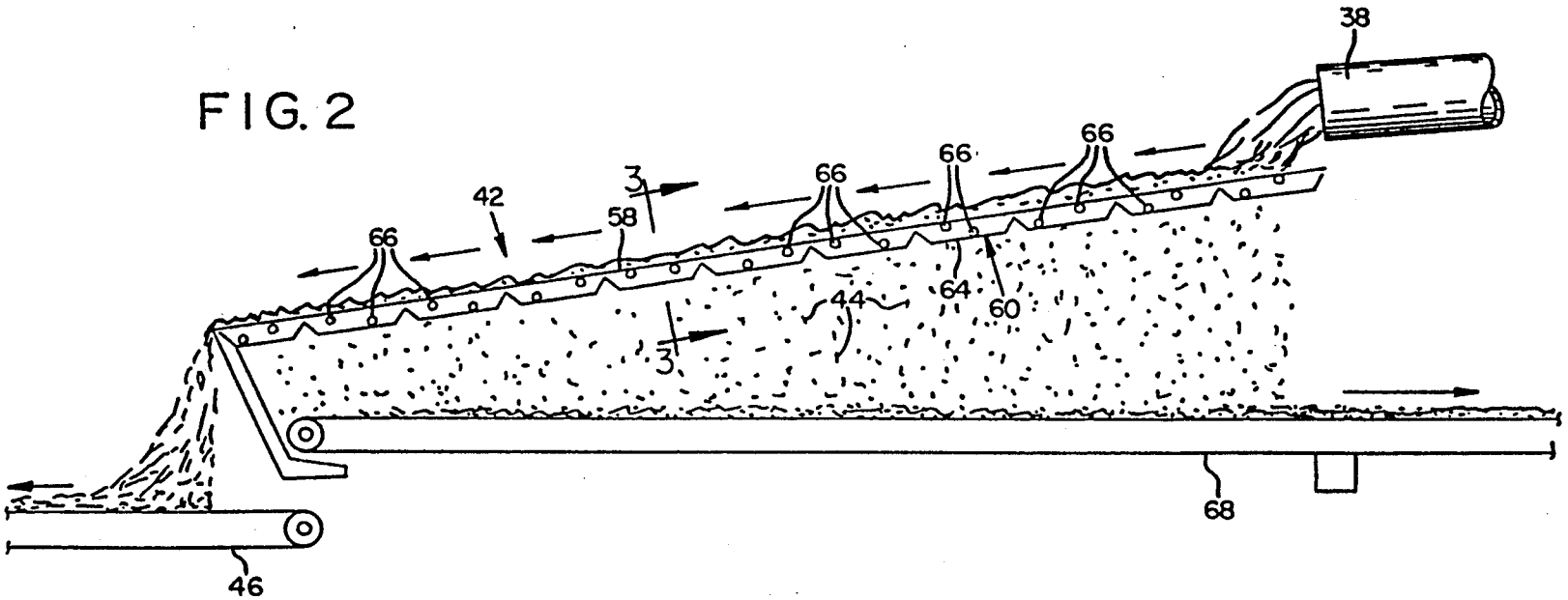
FIG. 2 is a view of that portion of the system of FIG. 1 relating to the sawdust screening operation of the invention.
Figure 5:
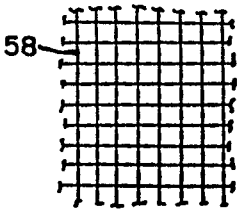
FIG. 5 is a view of the screen as taken on view line 5—5 of FIG. 3.

The screening apparatus 42 is more fully illustrated in FIGS. 2 and 5. As explained, the concept of separating out the "flour" component of sawdust ran counter to prevailing industry belief that benefits would not offset the cost and inconvenience of whatever separating process was employed. The mechanism for accomplishing the task also was not apparent. Screening a continuous mass of wet sawdust so as to separate out the particles having a size of 1/16 inch and larger (up to ¼ inch, e.g. number 3 screen size) was thought to be a major problem. The moistened sawdust particles stick together as a mass and the screen holes tend to plug up. Also, typical metal screen quickly rusts or corrodes from the moisture.

The answer to the screening problem was found in the food products industry. Grainy-type food products are screened by stainless steel metal screens for sanitary reasons. These stainless steel screens resist rust and corrosion. The problem of moving the material down a tilted screen is solved by agitating the screen produced by rubber balls that are bounced against the screen. The problem of plugging is avoided again due in part to the bouncing balls and to the stainless steel finish on the screen. The water that becomes coated on the screen surface acts like a lubricant and thus the moistened sawdust, in effect, provides a self-lubricating feature that enhances the screening of the flour material. (It was found desirable nevertheless to maintain some control over the moisture content of the sawdust which was largely achieved by discouraging excessive use of water e.g. for lubricating saws during the various mill operations.)

Figure 4:
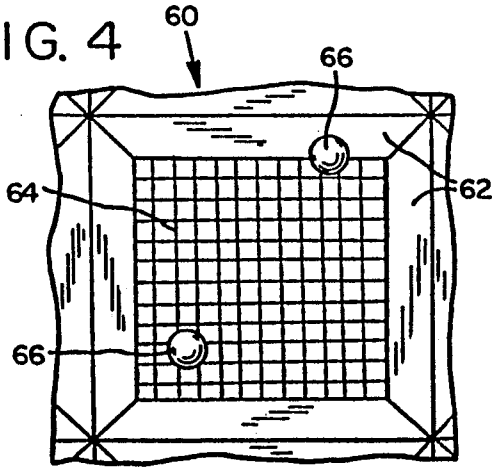
FIG. 4 is a view of the vibrating or agitating mechanism as taken on view line 4—4 of FIG. 3.
Figure 3:
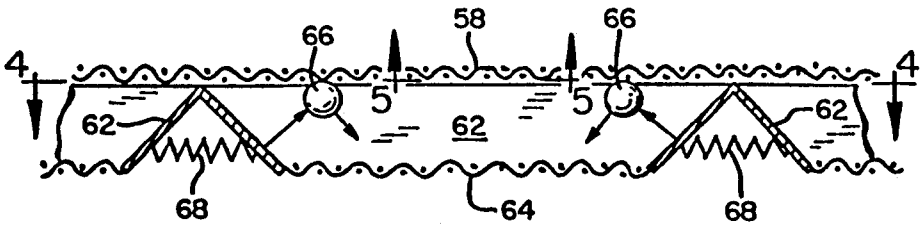
FIG. 3 is an enlarged section view of the screening apparatus as taken on view line 3—3 of FIG. 2.

Referring to FIGS. 2 and 5, the screen cover 58 is a number 12 size screen with the screen wires being stainless steel. The agitating mechanism 60 is shown in the plan view of FIG. 4. The entire surface area of the screen 58 and underlying agitating mechanism 60 may be in the order of 30-feet wide by 50-feet long. The agitating mechanism 60 is made up of a grid of one-foot squares, i.e. about 1500 one-foot squares, one of the squares being illustrated in FIGS. 3 and 4.

The frame of the grid is sheet metal formed into inverted V-shaped walls 62 that surround the interior of each square. The walls define enclosed chambers that are somewhat funnel shaped with the top overlaid with the continuous screen 58. The bottom of the chambers are covered by a screen 64 that has screen openings substantially greater than any of the sawdust particles 40. The openings of screen 58 are substantially smaller than the openings of screen 64. (FIG. 5 and screen 58 is substantially more enlarged than FIG. 4 and screen 64.)

Trapped within each chamber are rubber balls 66. Connected to the frame wall 62 and bottom screen 64 is an agitating mechanism, not shown but schematically illustrated by vibrating springs 68. The agitation of the wall 62 indicated by spring 68 is for the purpose of randomly bouncing the balls 66 around and within the chambers, but primarily up against the bottom of screen 58. The slanted walls help assure that the balls are moved about the chamber.

The screen 58 is angled downwardly at about an 8-degree slope from the outlet of conveyor 38 (the sawdust mixture receiving end) to the exit end of the screen where the "accepted" fibrous sawdust material is deposited onto, e.g. a conveyor 46. Movement of the sawdust down the screen is, of course, enhanced by the continuous jarring of the screen imparted by the bouncing balls. The "fines" or "flour" 40 pass through the screen openings of screen 64, which openings are only small enough to confine the rubber balls 66. The "flour" is collected on the conveyor 68 and directed to storage or the like for ultimate fuel consumption, schematically illustrated at reference 70 in FIG. 1.

The pulp industry will readily appreciate the extensive economic benefit to be derived from this invention and changes to the specific features of the disclosed apparatus and system are contemplated as the invention is adapted to various mills. Accordingly, the invention is not limited to the specific embodiment disclosed, but instead is encompassed by the claims appended hereto.

I claim:

1. A method for utilizing sawdust from lumber mills as pulp for paper production comprising;

collecting sawdust from lumber processing operations in a lumber mill wherein the sawdust is a mixture of wet sawdust particles of varying size from about number 3 screen size and smaller which particles stick together to resist separation by screening, establishing a discriminate size for the sawdust particles that delineate between sawdust particles of a larger size that produces strength enhancing fiber for pulp and smaller size sawdust particles that lack strength enhancing utility, providing a screen conveyor including a first screen having screen openings smaller than said discriminate size, said screen conveyor defining a receiving position and a removing position spaced from said receiving position, and the material of said screen being non-corrosive to moisture and substantially friction free, continuously depositing the wet sawdust mixture on the screen at the receiving position and conveying said mixture on said screen to said removing position, providing a grid-like structure under the first screen that includes numerous side-by-side enclosed chambers encompassing the under surface of the screen, said chambers enclosed at the top by said first screen, at the bottom by a lower screen having screen openings substantially larger than the first screen of said screen conveyor, and side walls enclosing the sides of said chambers, entrapping elastic balls in said chambers, agitating the structure to force bouncing of the balls within the chambers, and deflecting the bouncing balls to randomly impact the bottom of the first screen substantially over the entire overlying surface of the screen to produce a jarring motion and thereby jarring the wet sawdust mixture on the screen whereby particles adhered together due to the moistened condition thereof are jarred apart so as to be individually exposed to the screen openings for screening out the small particles, collecting the larger particles of the sawdust mixture conveyed to the removing position, producing sawdust pulp from the collected larger sized particles of sawdust and the smaller sized particles excluded from said sawdust pulp, and incorporating said sawdust pulp of larger sized particles as an ingredient in the production of paper.

2. A method as defined in claim 1 wherein the first screen has a finish that is non-corrosive and is compatible with the wet sawdust to be self-lubricating, and wherein said side walls are slanted for deflecting the balls in a random pattern about the chamber and toward the overlying first screen.

3. A method as defined in claim 2 wherein the screen openings of the first screen are about a number 12 screen size.

4. A method as defined in claim 3 wherein conveying of the sawdust is achieved by sloping the screen downwardly from the receiving position to the removing position, said jarring of the screen inducing movement of the sawdust along the screen.

5. A method for utilizing sawdust from lumber mills as pulp for paper production comprising;

collecting wet sawdust of about number 3 screen size and smaller generated in a lumber producing operation and transferring the wet sawdust to a screening station, said sawdust comprised of particles which due to the moisture adhere together and resist screening, depositing the wet sawdust onto a first screen having screen openings of a discriminate size determined as the minimum size desirable for pulp production and having no significant fiber length, providing a grid-like structure under the screen that includes numerous side-by-side enclosed chambers encompassing the under surface of the first screen, said chambers enclosed at the top by said first screen, at the bottom by a lower screen having screen openings substantially larger than the screen of the first screen, and side walls enclosing the sides of said chambers, entrapping elastic balls in said chambers, agitating the structure to force bouncing of the balls within the chambers, and deflecting the bouncing balls to randomly impact the bottom of the first screen substantially over the entire overlying surface of the screen and thereby jarring the mixture of wet sawdust deposited thereon to break the adhesive bonding of the particles and enable smaller particles to pass through the first screen while rejecting passage of larger particles, removing and collecting the larger sawdust particles rejected in the screening steps and transferring the collected sawdust particles to a sawdust cooker for producing sawdust pulp, said smaller sawdust particles excluded from said sawdust pulp, and incorporating the sawdust pulp of the larger sawdust particles as an ingredient in the production of paper.

* * * * *